US006564865B1

(12) United States Patent
Brady et al.

(10) Patent No.: US 6,564,865 B1
(45) Date of Patent: May 20, 2003

(54) OIL AND GAS PRODUCTION WITH DOWNHOLE SEPARATION AND REINJECTION OF GAS

(75) Inventors: Jerry L. Brady, Anchorage, AK (US); James L. Cawvey, Anchorage, AK (US); John M. Klein, Anchorage, AK (US); Mark D. Stevenson, Anchorage, AK (US); Steven J. Svedeman, San Antonio, TX (US); Steven P. Petullo, San Antonio, TX (US); Kerry N. Oliphant, Sandy, UT (US)

(73) Assignee: Conocophillips Company, Houston, TX (US)

( * ) Notice: Subject to any disclaimer, the term of this patent is extended or adjusted under 35 U.S.C. 154(b) by 0 days.

(21) Appl. No.: 10/025,444

(22) Filed: Dec. 19, 2001

(51) Int. Cl.[7] ..... E21B 43/00

(52) U.S. Cl. ..... 166/105.3; 166/266; 166/370; 166/105.6; 166/105.4; 95/261; 95/270; 96/196; 96/216

(58) Field of Search ..... 166/105.5, 265, 166/266, 169, 369, 370, 105.6, 105, 105.1, 105.3, 105.4; 95/261, 269, 270; 96/177, 195, 196, 216

(56) References Cited

U.S. PATENT DOCUMENTS

| | | | | |
|---|---|---|---|---|
| 5,794,697 | A | | 8/1998 | Wolflick et al. |
| 6,026,901 | A | | 2/2000 | Brady et al. |
| 6,035,934 | A | | 3/2000 | Stevenson et al. |
| 6,113,675 | A | * | 9/2000 | Branstetter |
| 6,189,614 | B1 | | 2/2001 | Brady et al. |
| 6,260,619 | B1 | * | 7/2001 | Svedeman et al. |
| 6,283,204 | B1 | | 9/2001 | Brady et al. |
| 6,494,258 | B1 | * | 12/2002 | Weingarten |

* cited by examiner

*Primary Examiner*—Roger Schoeppel
(74) *Attorney, Agent, or Firm*—Drude Faulconer

(57) ABSTRACT

A system for producing a mixed gas-oil stream which contains solid particulates wherein gas is to be separated and compressed downhole in a turbine-driven compressor before the gas is injected into a subterranean formation. The stream is passed through an upstream separator to separate out the particulates which pass through a first and second set of slots into first and second passages, both of which empty into a bypass through the turbine whereby the separated particulates do not contact the rotary vanes of the turbine thereby alleviating the erosive effects of the solids in the produced stream.

22 Claims, 7 Drawing Sheets

OIL AND GAS PRODUCTION WITH DOWNHOLE SEPARATION AND REINJECTION OF GAS

TECHNICAL FIELD

The present invention relates to separating certain components of a flow stream and in one aspect relates to a subsurface system for separating a portion of the gas from a gas-oil production stream, passing the separated gas through a downhole turbine-compressor unit to compress and reinject the separated gas into a downhole formation and wherein particulate material (e.g. sand) is separated from the production stream and is by-passed around the turbine to prevent damage to the turbine.

BACKGROUND

It is well known that many hydrocarbon reservoirs produce extremely large volumes of gas along with crude oil and other formation fluids, e.g. water. In producing fields such as these, it is not unusual to experience gas-to-oil ratios (GOR) as high as 25,000 standard cubic feet per barrel (scf/bbl.) or greater. As a result, large volumes of gas must be separated from the liquids before the liquids are transported for further processing, storage, and/or use. Where the production sites are near or convenient to large markets, this gas is considered a valuable asset when demands for gas are high. However, when demands are low or when a producing reservoir is located in a remote area, large volumes of produced gas can present major problems since production may have to be shut-in or at least drastically reduced if the produced gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which often overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored" in an appropriate, subterranean permeable formation from which it can be recovered later when the situation dictates.

To reinject the gas, large and expensive separation and compression surface facilities must be built at or near the production site. A major economic consideration in such facilities is the relatively high cost of the gas compressor train which is typically needed to compress the produced gas for reinjection. As will be understood, significant cost savings can be realized if these gas compressor requirements can be reduced.

Various methods and systems have been proposed for reducing some of the separating/handling steps normally required at the surface to process and/or re-inject at least a portion of the produced gas. These methods all basically involve the downhole separation of at least a portion of the gas from the production stream and then handling the separated gas and the remainder of the production stream separately from each other.

For example, one such method involves the positioning of an "auger" separator downhole within a production wellbore which separates a portion of the gas from the production stream as the stream flows upward through the wellbore; see U.S. Pat. No. 5,431,228, issued Jul. 11, 1995. The remainder of the production stream and the separated gas are then flowed to the surface through separate flowpaths where each is individually handled. While this reduces the amount of separation which would otherwise be required at the surface, the gas which is separated downhole still has to be handled at the surface.

One downhole gas separation system adapted to reduce the required surface compressor horsepower is fully disclosed and claimed in U.S. Pat. No. 5,794,697, issued Aug. 18, 1998 wherein a subsurface processing and reinjection compressor (SPARC) is positioned downhole in the wellbore. The SPARC includes an auger separator which separates a portion of the gas from the production stream and then compresses the separated gas by passing it through a turbine-driven compressor which, in turn, is driven by production stream, itself. The compressed gas is not produced to the surface but instead is injected directly into a designated formation (e.g. gas cap) within the production wellbore. For other similar downhole gas separation systems utilizing SPARCS, see U.S. Pat. Nos. 6,035,934 and 6,189,614.

Most production streams, in addition to gas, oil, and water, may contain substantial volumes of particulate material (e.g. sand). Since the production stream is also the power fluid which drives the turbine in the SPARC systems of this type, it can be seen that this entrained particulate material can cause severe erosion problems which may lead to the early failure of the SPARC. Accordingly, it is desirable to separate out as much as possible of the solid particulate material from the production stream before the stream is passed through the turbine of a SPARC.

Examples of SPARC systems which are capable of separating particulate material out of the production stream before the stream is passed through the turbine are disclosed in U.S. Pat. No. 6,026,901, issued Feb. 22, 2000 and U.S. Pat. No. 6,283,204 B1, issued Sep. 4, 2001. In these systems, liquids and particulate materials are spun outwardly as the production stream flows upward through the auger separator and are flowed upward through a spiral groove which is formed in the inner wall of the separator housing. The spiral groove empties into a passageway through the turbine housing which allows the separated particulates to bypass the turbine, itself, without passing therethrough.

The present invention is directed to this type of SPARC system wherein a substantial amount of the particulate material is separated from the production stream before the remainder of the production stream is passed through the turbine. By bypassing the separated particulate material, the erosion of the vanes of the turbine is significantly alleviated. Further, the upstream auger separator of the present invention can also be used to separate particulate and other heavy components from a flow stream at the surface.

SUMMARY OF THE INVENTION

The present invention provides a subsurface system for producing a mixed gas-oil stream to the surface from a subterranean zone through a wellbore wherein at least a portion of said gas is separated from said mixed gas-oil stream downhole and is compressed before the compressed gas is re-injected into a formation adjacent the wellbore. As will be understood in the art, the production stream will likely also include some water and some solids (e.g. sand, debris, etc.) which will be produced with the oil and gas so, as used herein, "mixed gas-oil stream(s)" is intended to include such production streams.

More specifically, the present system for producing d mixed gas-oil stream having liquid, gas, and solid particulates therein from a subterranean zone is comprised of a string of tubing extending from the subterranean zone to the surface. A turbine-compressor section (SPARC) is positioned in the tubing and is adapted to separate at least a portion of said liquid and said solid particulates from said gas-oil stream as said stream flows upward through said tubing. The SPARC is comprised of an upstream separator section; a turbine-compressor section; and a downstream separator section.

The upstream separator section is comprised of a housing having a first passageway(s) and a second passageway(s) through a portion thereof and which terminate in respective outlets at the upper end of the housing. A first set of slots in said inner wall of the housing near the upper end of the first auger provides an inlet for the separated liquids and solids into the first passageway(s) while a second set of slots, spaced above the first set of slots, provides an inlet into the second passageway(s). The passageways and their respective sets of slots can be formed in a liner tube which, in turn, is then positioned within the upstream separator housing.

A central support extends substantially through the housing and has a first auger flight thereon which imparts a spin to the gas-oil stream as it flows therethrough to thereby separate at least some of the liquids and some of said solids from the gas-oil stream by forcing them outward towards the inner wall of the housing by centrifugal force while leaving the remainder of said gas-oil stream to flow against said central support. A second auger flight is mounted on said central support and spaced above said first auger flight with the second set of slots being positioned between the auger flights. The second auger flight acts to "deswirl" said oil-gas stream after said stream has passed through said first auger flight.

While the present upstream auger is especially useful in a downhole SPARC, it should be recognized that it can also be used at the surface to separate heavy components from a multi-component flow stream; e.g. processing a production stream after it has been produced to the surface.

The turbine-compressor section is positioned above the upstream auger separator and is comprised of a housing which has an inlet and an outlet. A shaft is journaled in the housing and has a plurality of turbine vanes affixed to one end thereof which, in turn, are positioned between the inlet and outlet of the housing. The inlet of the turbine is adapted to receive the remainder of the production stream after at least a portion of the liquids and solid particulates have been separated therefrom by the upstream separator. A bypass passage in said turbine housing fluidly connecting the outlets of the first and second passageways to the turbine outlet whereby the separated solids will bypass the turbine vanes. This substantially reduces the erosion of the turbine rotary vanes and significantly extends the operational life of the turbine.

The outlet of the bypass passage is in fluid communication with the outlet of the turbine whereby the bypass fluids and solid particulates are recombined with the remainder of the stream after the remainder of the stream has passed through the rotary turbine vanes. The recombined stream flows into the inlet of the downstream auger separator which, in turn, is comprised of a central hollow tube having an auger flight thereon. One end of the tube is fluidly connected to the inlet of the compressor which, in turn, is positioned above the turbine and is by the shaft of the turbine.

The other end of the tube has an bellmouthed inlet which allows gas that has been separated by the downstream separator to enter the tube and flow into the compressor where it is compressed before it is reinjected into a formation, e.g. gas cap, adjacent the wellbore. A deswirl auger is positioned above the gas inlet on the hollow tube to deswirl the production stream after the gas has been separated therefrom and to act as a "rain hat" to prevent liquid from entering the gas inlet. The production stream, minus the separated gas, flows out of the downstream separator and into the production tubing through which it is then produced to the surface.

BRIEF DESCRIPTION OF THE DRAWINGS

The actual construction, operation, and apparent advantages of the present invention will be better understood by referring to the drawings which are not necessarily to scale and in which like numerals refer to like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

BEST KNOWN MODE FOR CARRYING OUT THE INVENTION

Figure 1:
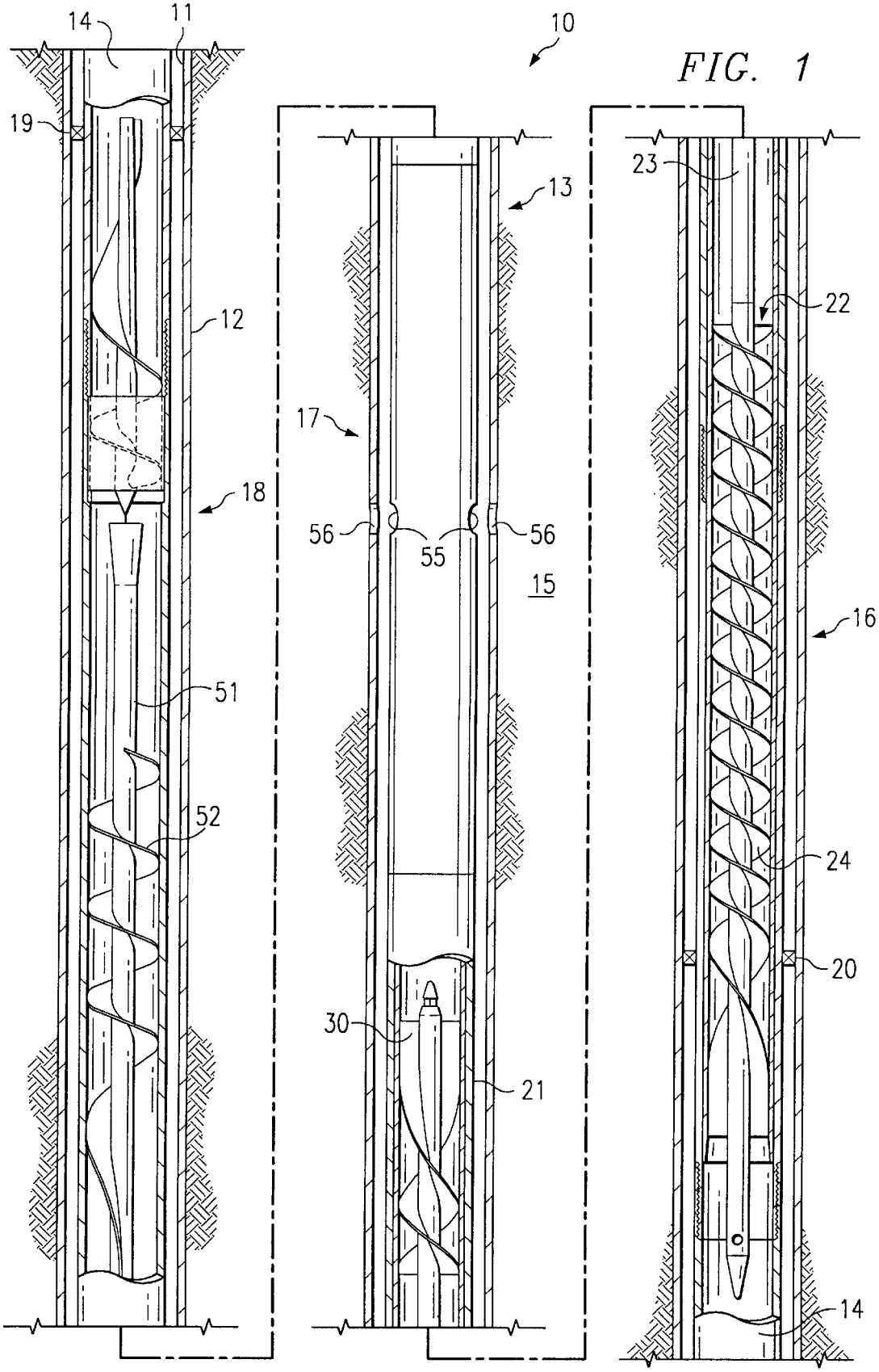
FIG. 1 is a sectional view of the complete subsurface separator-compressor (SPARC) system of the present invention when in an operable position within a production wellbore.

Referring more particularly to the drawings, FIG. 1 discloses a downhole section of production well 10 having a wellbore 11 which extends from the surface into and/or through a production zone (neither shown). As illustrated in FIG. 1, wellbore 11 is cased with a string of casing 12 which is perforated or otherwise completed (not shown) adjacent the production zone to allow flow of fluids from the production zone into the wellbore as will be fully understood by those skilled in the art. While well 10 is illustrated in FIG.

1 as one having a substantial vertical, cased wellbore, it should be recognized that the present invention can equally be used in open-hole and/or underreamed completions as well as in inclined and/or horizontal wellbores.

Still further, although the subsurface processing and reinjection compressor (SPARC) system 13 of the present invention has been illustrated as being assembled into a string of production tubing 14 and lowered therewith into the wellbore 11 to a position adjacent formation 15 (e.g. a gas cap above a production formation), it should be recognized the system 13 could be assembled as a unit and then lowered through the production tubing 14 by a wireline, coiled tubing string, etc. after the production tubing has been run into the wellbore 11.

As shown, system 13 is basically comprised of three major components; a first or upstream auger separator section 16, turbine-compressor section 17, and a second or downstream auger separator section 18. Packers 19, 20 are spaced between system 13 and casing 12 for a purpose described below.

The first or upstream auger separator section 16 is comprised of an auger separator housing 21 which, in turn, is fluidly connected at its lower end into production tubing string 14 to receive the flow of the production stream as it flows upward through the tubing. An auger separator 22 is positioned within the housing 21 and is adapted to impart a spin on the production stream as it flows therethrough for a purpose to be described later. As shown, auger separator 22 is comprised of a central rod or support 23 having a helical-wound, auger-like flight 24 secured thereto. Auger flight 24 is coiled to impart a swirl to the production stream to thereby separate heavy liquids and particulate material from the production stream as the stream flows upward through the auger separator 24.

Auger separators of this general type are known in the art and are disclosed and fully discussed in U.S. Pat. No. 5,431,228 which issued Jul. 11, 1995, and which is incorporated herein in its entirety by reference. Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex.

Figure 2:
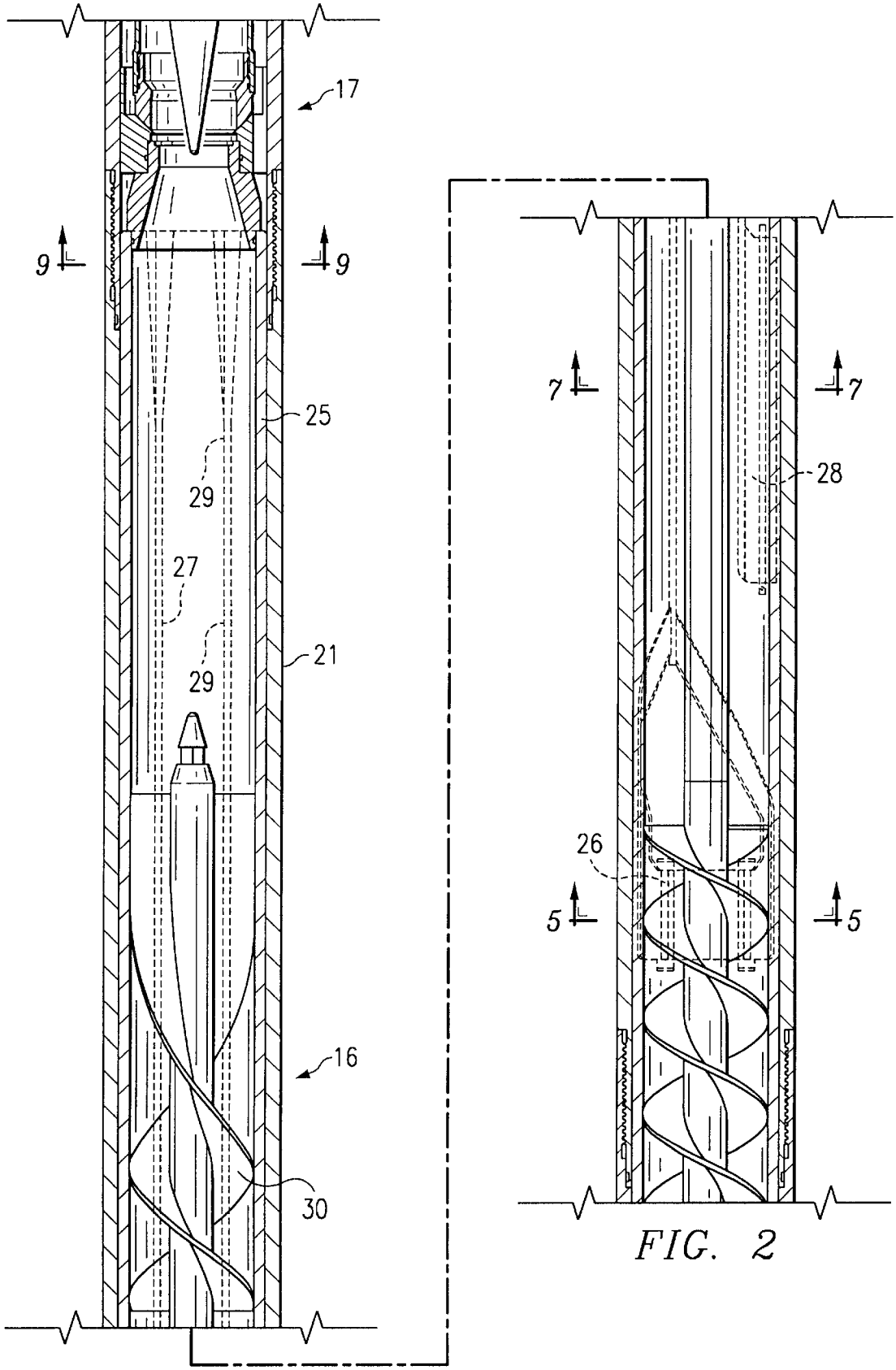
FIG. 2 is an enlarged, sectional view of the upper portion of the upstream auger section of the SPARC system of FIG. 1.
Figure 3:
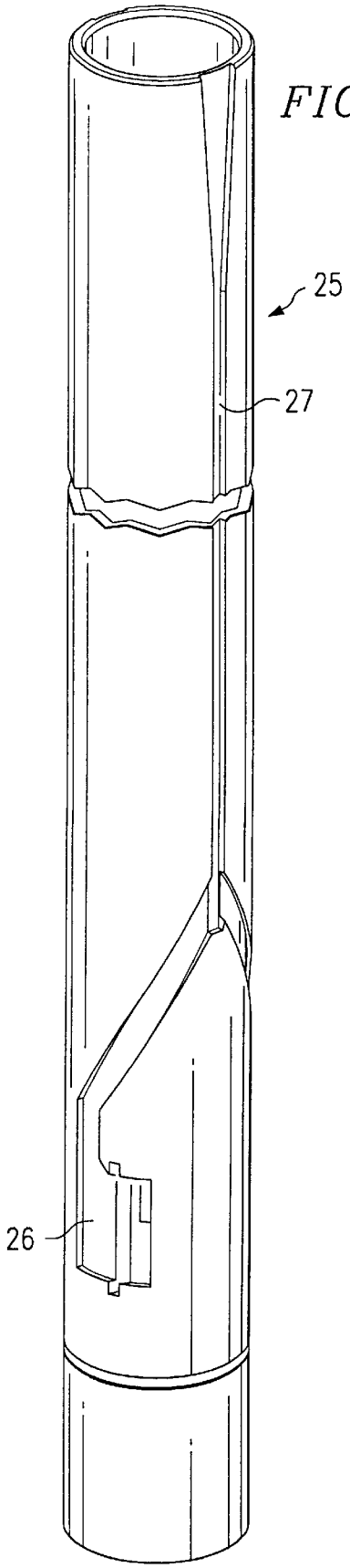
FIG. 3 is an enlarged, perspective view of the tube which fits within the auger housing of the SPARC system of FIG. 1.
Figure 4:
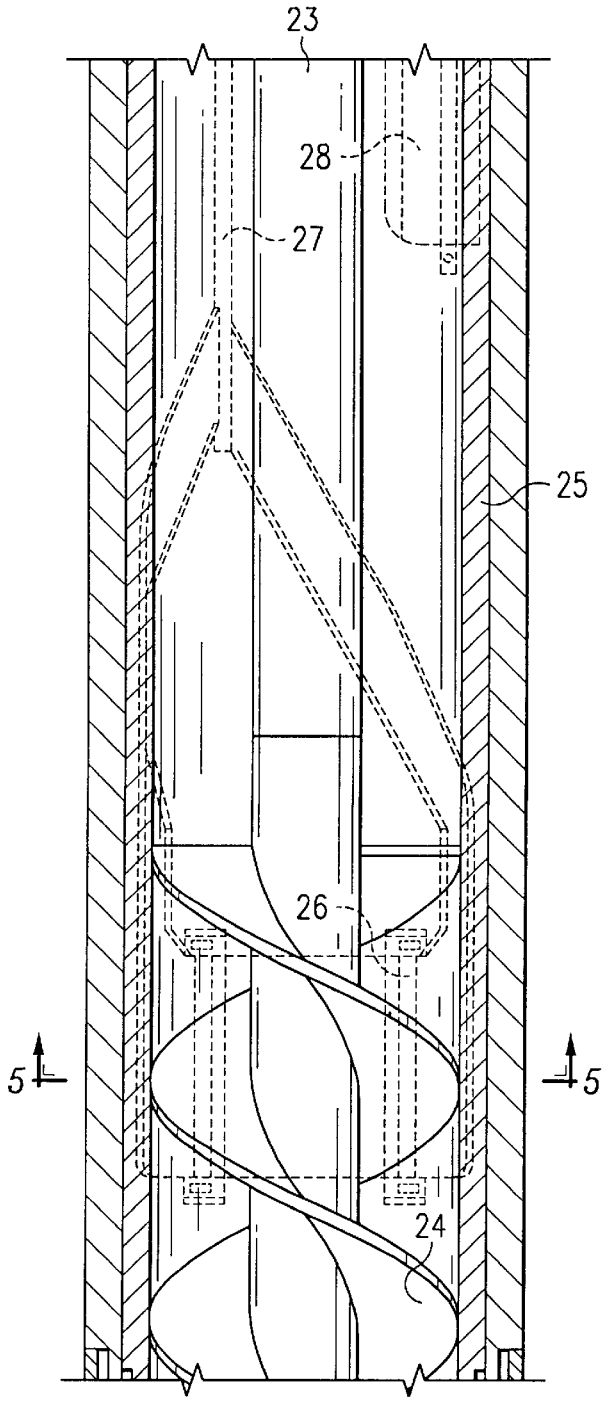
FIG. 4 is a further-enlarged, broken-away sectional view of a portion the auger housing and tube of FIG. 1 showing a first set of take-off slots for particulate material.
Figure 5:
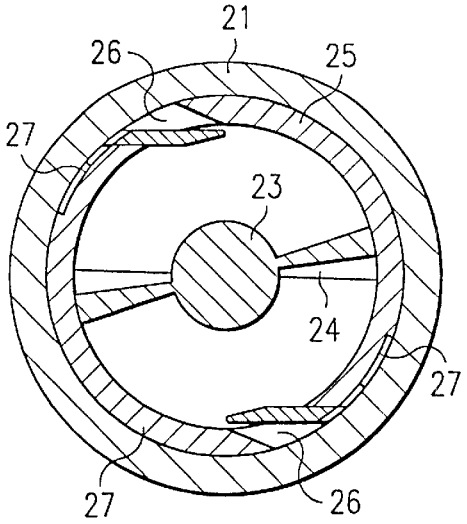
FIG. 5 is a cross-sectional view taken along line 5—5 of FIG. 4.
Figure 7:
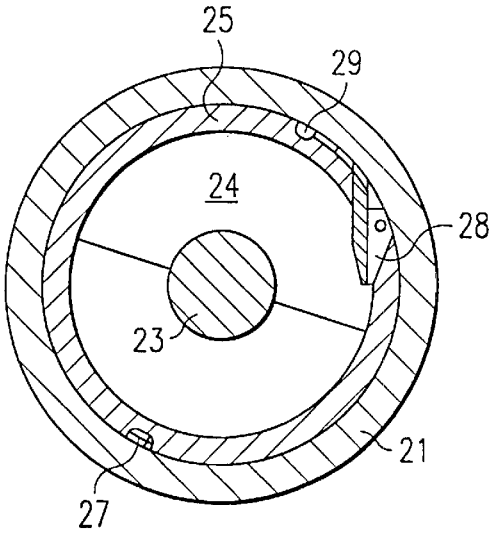
FIG. 7 is a cross-sectional view taken along line 7—7 of FIG. 6.
Figure 6:
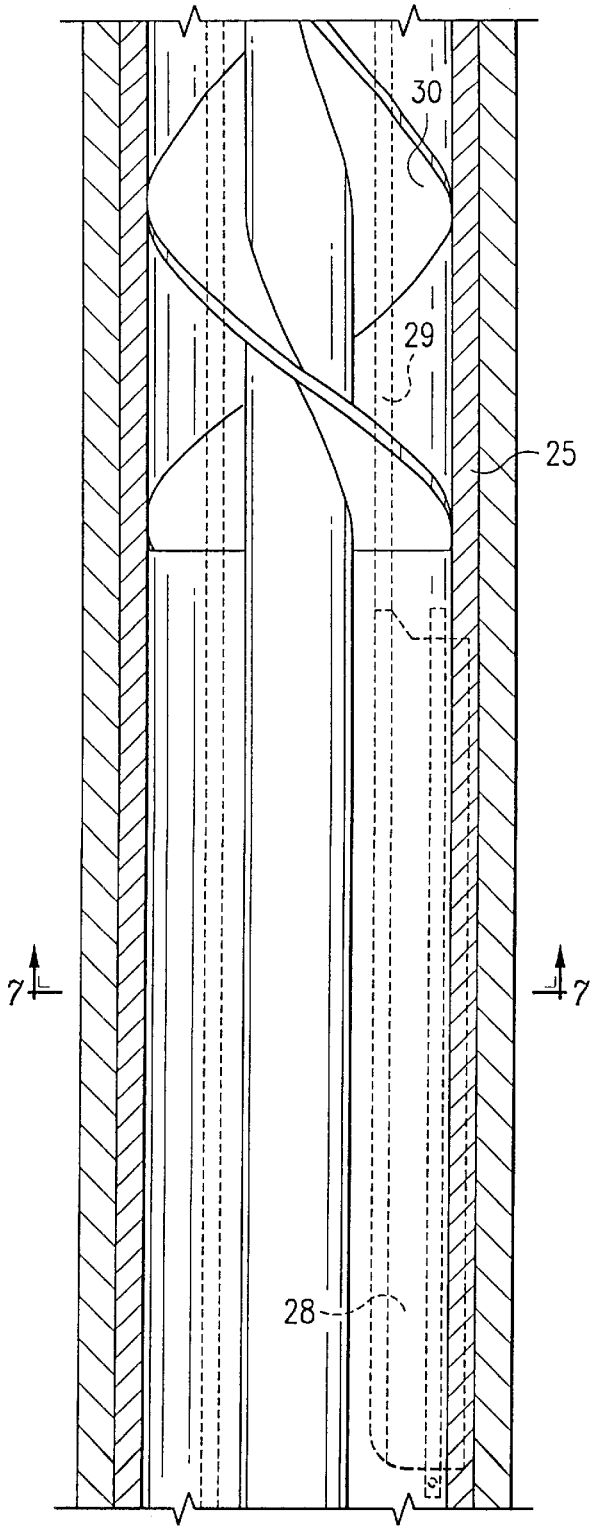
FIG. 6 is a further-enlarged, broken-away sectional view of another portion the auger housing and tube of FIG. 1 showing a second set of take-off slots for particulate material.

Referring now to FIGS. 2 and 3, a liner tube 25 is affixed within housing 21 and extends from just below the top of auger flight 24 to a point adjacent the lower end of turbine-compressor section 17. Liner 25 has a first set of take-off slots 26 (i.e. one or more) therein which lie substantially adjacent the upper end of auger flight 24 (FIG. 4). The slots 26 open into a groove(s) 27 which, in turn, extends in and longitudinally along liner 25. Groove 27 forms a first passage within housing 21 when the liner is assembled within the housing; the purpose of this passage being described below. As used herein and throughout the claims, the term "first passage" is intended to include one or more longitudinally extending passages through housing 21 which are adapted to receive flow through the first set of take-off slots 26.

Liner 25 also has a second set of take-off slot(s) 28 (i.e. one or more) which is spaced above or downstream of the first set of slots 26. Second slot(s) 28 open into a longitudinal groove(s) 29 which forms a second passage within housing 21 when the tube is in its assembled position. While only one longitudinal groove 29 has been shown, the term "second passage", as used herein and throughout the claims, is intended to include one or more longitudinally extending passages through housing 21 which are adapted to receive flow through the second set of take-off slots 28.

A second or "deswirl" auger flight 30 is mounted on support 23 and is spaced above or downstream from first auger flight 24. Second auger 30 is normally significantly shorter in length than first auger 24 and is coiled to "deswirl" the production stream after it has passed through first auger 24 as will be more fully described below. The second set of slot(s) 28 in liner tube 25 is located to lie within the blank portion of support 23 which is present between the first auger flight 24 and second auger flight 30. While upstream auger separator 16 has been described as part of SPARC 13, it should be recognized that it can also be used by itself in other environments, e.g. on the surface, to separate heavy components, e.g. particulate material, from a multi-component flow stream.

Figure 8:
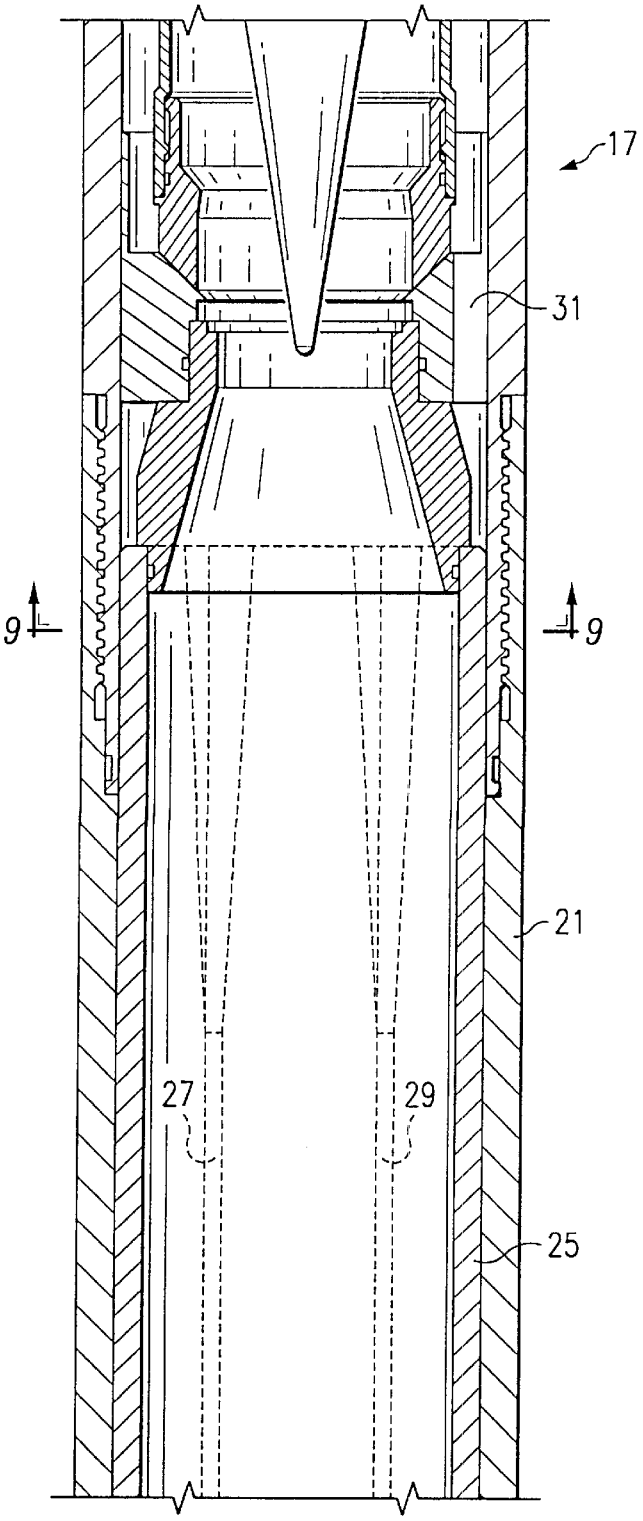
FIG. 8 is a further-enlarged, broken-away sectional view of the upper portion the auger housing and tube of FIG. 1 showing the entrance into the turbine by-pass.
Figure 9:
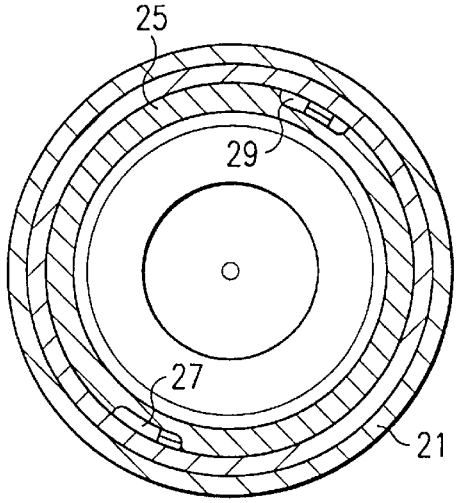
FIG. 9 is a cross-sectional view taken along line 9—9 of FIG. 8.
Figure 10:
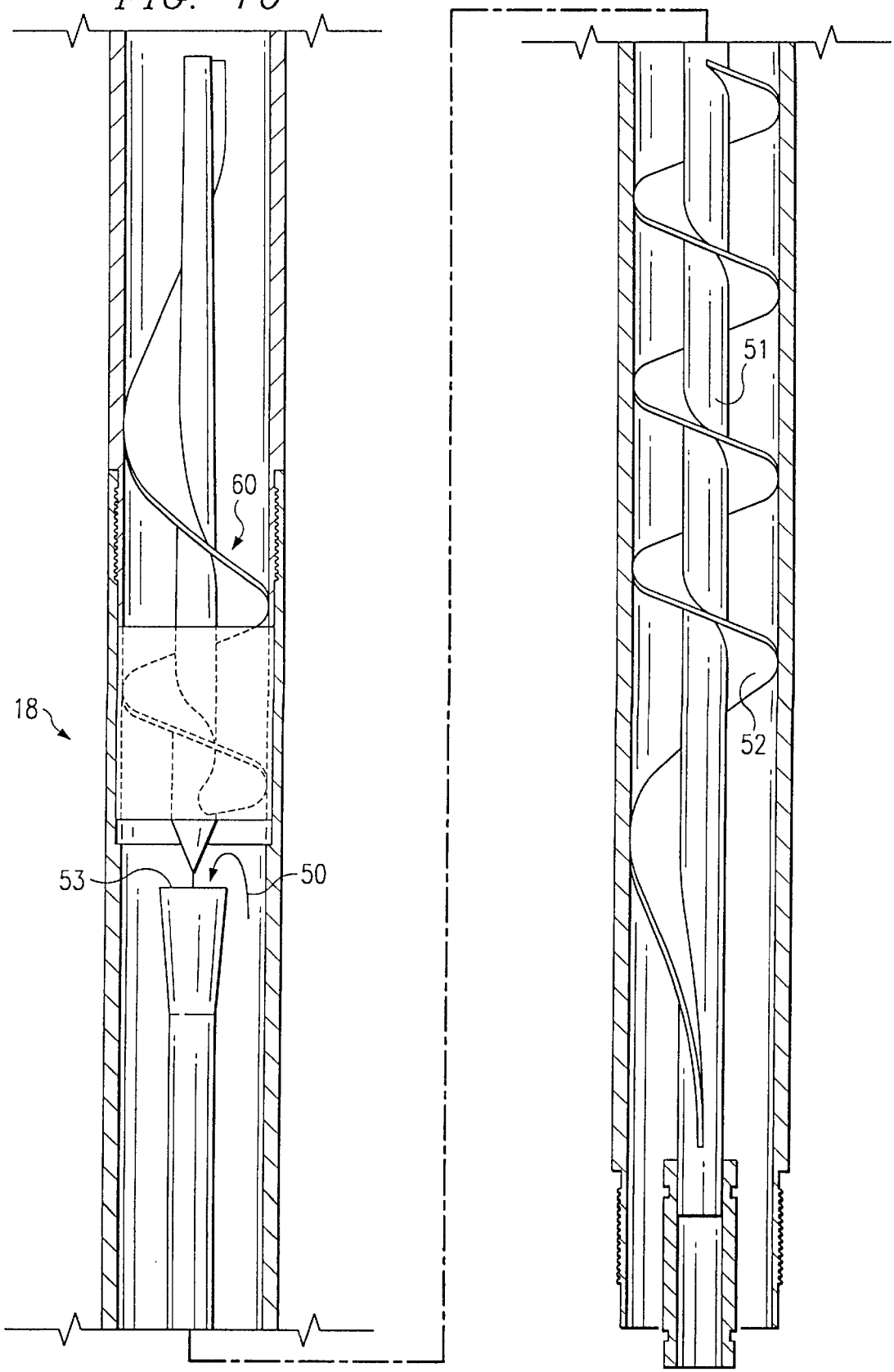
FIG. 10 is an enlarged, sectional view of the downstream auger section of the SPARC system of FIG. 1.
Figure 11:
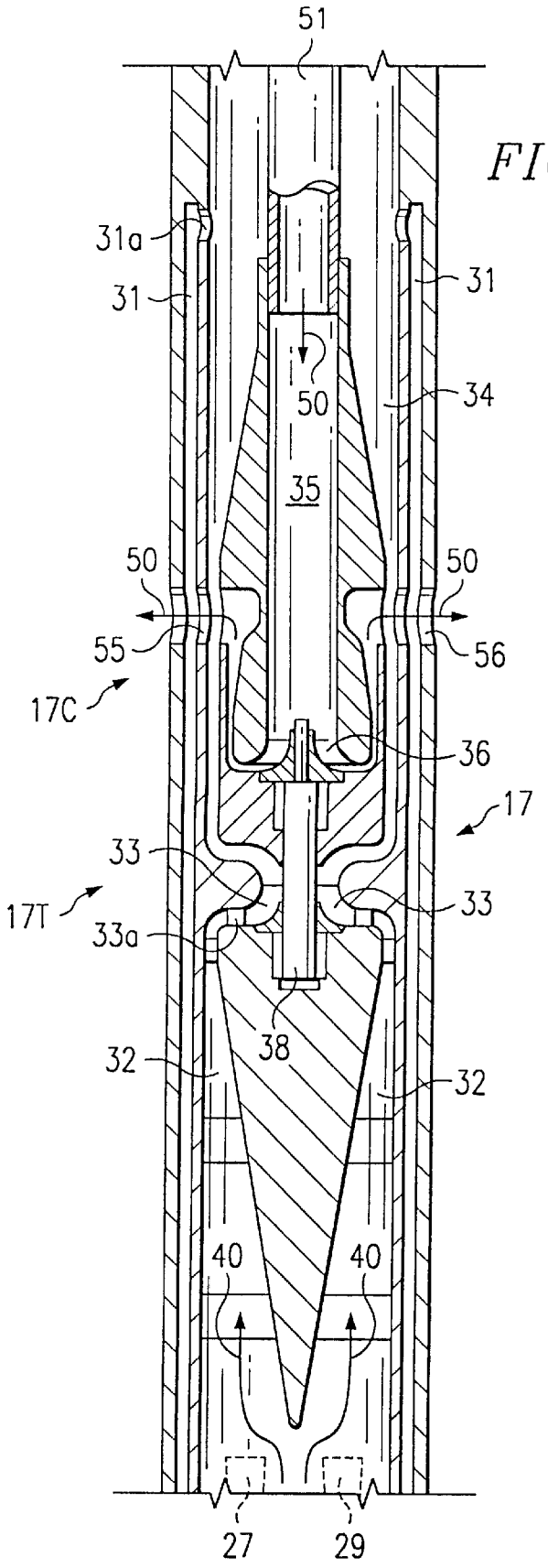
FIG. 11 is an enlarged, sectional view of the turbine-compressor section of the system of FIG. 1.

Referring now to FIGS. 8 and 11, it can be seen that passages 27 and 29 both open into by-pass passage 31 which is formed through the turbine-compressor section 17. Turbine-compressor section 17 may vary in construction but as illustrated in FIG. 11, section 17 is comprised of a turbine 17T and a compressor 17C. Turbine 17T is comprised of an inlet(s) 32, rotary vanes 33 mounted on shaft 38, stationary vanes 33*a*, and an outlet 34. Compressor 17C is comprised of an inlet 35, rotary vanes 36 mounted on the other end of shaft 38, and an outlet(s) 31.

As will be understood, as a power fluid flows through turbine section 17T, it will rotate vanes 33 which are attached to shaft 38, which, in turn, will rotate vanes 36 in compressor section 17C to thereby compress gas as it flows therethrough. Bypass passage 31 extends through turbine-compressor section 17 and allows solid particulate-laden fluids to by-pass turbine 17T thereby alleviating the erosive effects of such fluids and solids on the turbine vanes.

In operation, a mixed gas-oil stream 40 from a subterranean, production zone (not shown) flows upward to the surface (not shown) through production tubing 14. As will be understood in the art, most mixed oil-gas streams will include some produced water so as used herein, "mixed oil-gas stream" is intended to include streams having some produced water therein. Also, it is not uncommon for most production streams to also include substantial amounts of solid particulate material (e.g. sand produced from the formation, rust and other debris, etc.).

As the mixed gas-oil stream flows upward through separator section 16, auger flight 24 of auger separator 22 will impart a spin or swirl on the stream wherein the heavier components of the stream (e.g. oil, water, and the solid particulates) in the stream are forced to the outside of the auger by centrifugal force while the gas and other liquids remains near the wall of center rod 23. As the stream flows toward the upper end of separator housing 21, the heavier components (i.e. liquids and particulates) will exit through first take-off slots 26 located near the top of auger 24 and will flow upward through first passage 27.

As the production stream exits from the top of auger flight 24, it flows through the "blank" portion of support 23; i.e. a portion having no auger blade thereon. It is believed that the separation of heavy liquids and particulates may be improved significantly in a area where there is a high swirl of the production stream without any auger blades being present. Tests have shown an increase of 10% or more over that which would otherwise be separated. While this increased separation is taking place in the blank portion of separator 22, additional particulate-laden liquid exits through the second set of take-off slots 28 and flows upward through second passage 29 in liner 25. When the separated heavier components (i.e. particulate-laden liquid) reach the upper ends of passages 27, 29, they flow into and through by-pass passage 31 and out openings 31*a* (FIG. 11) into turbine outlet(s) 34, thereby bypassing turbine vanes 33.

The remainder of gas-oil stream 40 continues to flow upward through first or upstream separator section 16 and passes through "deswirl" auger flight 30 which is mounted on support 23 at a spaced distance above auger flight 24 as explained above. As the stream passes therethrough, the swirl existing in the stream is significantly-reduced before it enters into inlet(s) 32 of the turbine 17C to rotate vanes 33, shaft 38, and vanes 36 in compressor 17C. This stream (i.e. gas-liquid) then flows through outlet(s) 34 of the turbine 17T where it is recombined with the particulate-laden stream from the bypass passage 31 (FIG. 11).

The recombined stream, which is now essentially the original production stream, flows through the second or downstream separator section 18 which, in turn, is comprised of a central hollow tube 51 having an auger flight 52 thereon. As the combined stream flows upward through the second separator 18, it will again be spun to force the heavier components, i.e. liquids and particulate material, outwardly by centrifugal force while a portion of the gas will separate and remain inside against the outer wall of central tube 51. As the gas 50 reaches the upper end of tube 51, it flows into the tube through an inlet 53 at the upper end thereof, preferably a bellmouth inlet.

The gas then flows down through tube 51 into inlet 35 of compressor 17C where it is compressed before it exits through outlet(s) 55 of the compressor. The compressed gas then flows into the space isolated between packers 19, 20 in the well annulus from which is injected into formation 15 through openings 55 (e.g. perforations) in casing 12 (FIG. 1).

The liquids and unseparated gas, along with the particulates, then flow through a second "deswirl" auger flight 60 which is positioned just above the bellmouth inlet 53 which significantly reduces the swirling effect of the stream before the stream flows upward into the production tubing 14 through which it is then produced to the surface. In addition to "deswirling" the stream before it is produced to the surface, second deswirl auger flight 60 also serves as a "rain hat" for gas inlet 53 in that it blocks droplets of liquid from entering the inlet of compressor 17C.

What is claimed is:

1. A separator-compressor system (SPARC) adapted to be positioned downhole in a production wellbore and adapted to separate at least a portion of the liquids and solid particulates from a mixed gas-oil production stream as said stream flows upward through said wellbore; said separator-compressor system comprising an upstream separator section; a turbine-compressor section; and a downstream separator section;

said upstream separator section comprising;

an upstream separator housing in fluid communication with said wellbore, said upstream separator housing having a first passageway extending longitudinally along a portion of said upstream separator housing and terminating in an outlet at the upper end of said upstream separator housing, a central support extending substantially through said upstream separator housing;

a first auger flight on said central support and extending along a substantial length thereof, whereby a spin will be imparted to said gas-oil stream as it flows through said first separator to thereby separate at least a portion of said liquids and said solid particulates from said gas-oil stream by forcing said at least some liquids and said solid particulates outward towards an inner wall of said upstream separator housing thereby leaving the remainder of said gas-oil stream to flow against said central support;

a first set of slots in said inner wall of said upstream separator housing near the upper end of said first auger flight which provide an inlet into said first passageway through which at least a portion of the separated liquids and solid particulates can flow;

and wherein said turbine-compressor section comprises:

a turbine positioned above said upstream separator section, said turbine comprising:

a turbine housing having an inlet and an outlet;

a plurality of stationary vanes affixed within said inlet of said turbine housing;

a shaft rotatably mounted in said turbine housing;

a plurality of rotary vanes affixed to one end of said shaft;

said inlet adapted to receive said remainder of said gas-oil stream for rotating said rotary vanes and said shaft; and a bypass passage in said turbine housing fluidly connecting said outlet of said first passageway to said outlet of said turbine housing whereby said at least some liquids and said solid particulates flow from said first passageway through said bypass passage in said turbine housing.

2. The SPARC of claim 1 including:

a second passageway extending longitudinally along a portion of said upstream separator housing and terminating in an outlet at the upper end of said upstream separator housing which, in turn, is fluidly connected to said bypass passage in said turbine housing; and a second set of slots in said inner wall of said upstream separator housing above the upper end of said first auger flight which provide an inlet into said second passageway whereby additional separated liquids and solid particulates pass into and flow through said second passageway into said bypass passage.

3. The SPARC of claim 2 including:

a second auger flight mounted on said central support and spaced above said first auger flight;

and wherein said second set of slots is positioned between said first auger flight and said second auger flight.

4. The SPARC of claim 3 wherein said first auger flight is coiled to impart spin on said oil-gas stream as said stream passes therethrough and said second auger flight is coiled to deswirl said oil-gas stream after said stream has passed through said first auger flight.

5. The SPARC of claim 3 wherein said turbine-compressor section further comprises:

a compressor positioned downstream of said turbine, said compressor comprising:

vanes mounted on the other end of said shaft of said turbine adapted to be driven by said shaft; and an inlet adapted to receive gas from said gas-oil stream to compress said gas.

6. The SPARC of claim 5 wherein said downstream separator section comprises:

a downstream separator housing positioned above said turbine-compressor section;

a central hollow support tube positioned within said downstream separator housing, said hollow tube being fluidly connected to said inlet of said compressor at its lower end and having an gas inlet opening at its upper end; and an auger flight affixed to said central hollow tube and extending along a substantial portion of the length thereof to impart a spin on said oil-gas stream to separate at least a portion of said gas from the remainder of said stream.

7. The SPARC of claim 6 wherein said gas inlet opening at the upper end of said hollow tube is bellmouthed.

8. The SPARC of claim 7 including:

a deswirl auger positioned within said downstream separator housing and spaced above said gas inlet at the upper end of said hollow tube.

9. The SPARC of claim 1 including:

a liner tube positioned within said upstream separator housing and extending from below the top of said first auger flight to the bottom of said turbine-compressor section; said liner tube having at least one first groove and at least one second groove extending longitudinally along the outer surface thereof and terminating in a respective outlet at the upper end of said downstream separator housing; said at least one first groove and said at least one second groove forming said first passageway and second passageway, respectively, in said downstream separator housing; and said liner tube having said first set of slots and second set of slots formed therein to form the respective inlets for said first passageway and said second passageway.

10. An auger separator comprising:

a housing having a first passageway extending longitudinally along a portion of said housing and terminating in an outlet at the upper end thereof;

a central support extending substantially through said housing;

a first auger flight on said central support and extending along a substantial length thereof, whereby a spin will be imparted to a multi-component flow stream as the flow stream flows through said housing to thereby separate at least some of the heavier components from said flow stream by forcing said at least some heavier components outward towards the inner wall of said housing;

a first set of slots in said inner wall of said housing near the upper end of said first auger flight which provide an inlet into said first passageway through which at least a portion of the separated heavier components can flow;

a second passageway extending longitudinally along a portion of said housing and terminating in an outlet at the upper end thereof; and a second set of slots in said inner wall of said upstream separator housing above the upper end of said first auger flight which provide an inlet into said second passageway whereby additional separated heavier components can pass into and flow through said second passageway.

11. The auger separator of claim 10 including:

a second auger flight mounted on said central support and spaced above said first auger flight;

and wherein said second set of slots is positioned between said first auger flight and said second auger flight.

12. The auger separator of claim 11 wherein said first auger flight is coiled to impart spin on said oil-gas stream as said stream passes therethrough and said second auger flight is coiled to deswirl said oil-gas stream after said stream has passed through said first auger flight.

13. The auger separator of claim 11 including:

a liner tube positioned within said housing and extending substantially from below the top of said first auger flight to the upper end of said housing; said liner tube having at least one first groove and at least one second groove extending longitudinally along the outer surface thereof and terminating in a respective outlet at the upper end of said housing; said at least one first groove and said at least one second groove forming said first passageway and said second passageway, respectively, in said housing; and said liner tube having said first set of slots and said second set of slots formed therein to form the respective inlets for said first passageway and said second passageway.

14. A subsurface system for producing a mixed gas-oil stream having liquids, gas, and solid particulates therein from a subterranean zone to the surface through a wellbore said system comprising:

a string of tubing positioned within said wellbore and extending from said subterranean zone to said surface;

a separator-compressor system positioned downhole in said tubing and adapted to separate at least a portion of said liquids and said solid particulates from said gas-oil stream as said stream flows upward through said tubing; said separator-compressor system comprising an upstream separator section; a turbine-compressor section; and a downstream separator section;

said upstream separator section comprising;

an upstream separator housing in fluid communication with said tubing; said upstream separator housing having a first passageway extending longitudinally along said upstream separator housing and terminating in an outlet at the upper end of said upstream separator housing;

a central support extending substantially through said upstream separator housing;

a first auger flight on said central support and extending along a substantial length thereof, whereby a spin will be imparted to said gas-oil stream as it flows through said first separator to thereby separate at least some of said liquids and said solid particulates from said gas-oil stream by forcing said at least some liquids and said solid particulates outward towards an inner wall of said upstream separator housing thereby leaving the remainder of said gas-oil stream to flow against said central support;

a first set of slots in said inner wall of said upstream separator housing near the upper end of said first auger flight which provides an inlet into said first passageway whereby at least a portion of the separated liquids and solid particulates pass into and flow through said first passageway;

and wherein said turbine-compressor section comprises:

a turbine positioned downhole within said tubing above said first separator, said turbine comprising:

a turbine housing having an inlet and an outlet;

a shaft rotatably mounted in said turbine housing;

a plurality of rotary vanes affixed to one end of said shaft;

said inlet adapted to receive said remainder of said gas-oil stream for rotating said rotary vanes and said shaft; and a bypass passage in said turbine housing fluidly connecting said outlet of said first passageway to said outlet of said turbine housing whereby said at least some liquids and said solid particulates flow from said first passageway through said bypass passage in said turbine housing.

15. The subsurface system of claim 14 including:

a second passageway extending longitudinally along a portion of said upstream separator housing and terminating in an outlet at the upper end of said upstream separator housing which, in turn, is fluidly connected to said bypass passage in said turbine housing; and a second set of slots in said inner wall of said upstream separator housing above the upper end of said first auger flight which provide an inlet into said second passageway whereby additional separated liquids and solid particulates pass into and flow through said second passageway into said bypass passage.

16. The subsurface system of claim 15 including:

a second auger flight mounted on said central support and spaced above said first auger flight;

and wherein said second set of slots is positioned between said first auger flight and said second auger flight.

17. The subsurface system of claim 16 wherein said first auger flight is coiled to impart spin on said oil-gas stream as said stream passes therethrough and said second auger flight is coiled to deswirl said oil-gas stream after said stream has passed through said first auger flight.

18. The subsurface system of claim 17 wherein said turbine-compressor section further comprises:

a compressor positioned downstream of said turbine, said compressor comprising:

vanes mounted on the other end of said shaft of said turbine adapted to be driven by said shaft; and an inlet adapted to receive gas from said gas-oil stream to compress said gas.

19. The subsurface system of claim 18 wherein said downstream separator section comprises:

a downstream separator housing positioned above said turbine-compressor section;

a central hollow support tube positioned within said downstream separator housing, said hollow tube being fluidly connected to said inlet of said compressor at its lower end and having an gas inlet opening at its upper end; and an auger flight affixed to said central hollow tube and extending along a substantial portion of the length thereof to impart a spin on said oil-gas stream to separate at least a portion of said gas from the remainder of said stream.

20. The subsurface system of claim 19 wherein said gas inlet opening at the upper end of said hollow tube is bellmouthed.

21. The subsurface system of claim 20 including:

a deswirl auger positioned within said downstream separator housing and spaced above said gas inlet at the upper end of said hollow tube.

22. The subsurface system of claim 14 including:

a liner tube positioned within said upstream separator housing and extending from below the top of said first auger flight to the bottom of said turbine-compressor section; said liner tube having at least one first groove and at least one second groove extending longitudinally along the outer surface thereof and terminating in a respective outlet at the upper end of said downstream separator housing; said at least one first groove and said at least one second groove forming said first passageway and said second passageway, respectively, in said downstream separator housing; and said liner tube having said first set of slots and said second set of slots formed therein to form the respective inlets for said first passageway and said second passageway.

* * * * *